US011815324B2

(12) United States Patent
Zedrosser et al.

(10) Patent No.: US 11,815,324 B2
(45) Date of Patent: Nov. 14, 2023

(54) RIFLE WITH SHUTTER GROUP

(71) Applicant: FABBRICA D'ARMI PIETRO BERETTA S.P.A., Gardone Val Trompia (IT)

(72) Inventors: Ulrich Zedrosser, Gardone Val Trompia (IT); Fausto Caravaggi, Gardone Val Trompia (IT); Emanuele Cecchel, Gardone Val Trompia (IT)

(73) Assignee: FABBRICA D'ARMI PIETRO BERETTA S.P.A., Brescia (IT)

( * ) Notice: Subject to any disclaimer, the term of this patent is extended or adjusted under 35 U.S.C. 154(b) by 0 days.

(21) Appl. No.: 17/968,345

(22) Filed: Oct. 18, 2022

(65) Prior Publication Data

US 2023/0117721 A1 Apr. 20, 2023

(30) Foreign Application Priority Data

Oct. 18, 2021 (IT) ..... 102021000026651

(51) Int. Cl.
*F41A 3/20* (2006.01)
*F41A 3/66* (2006.01)

(52) U.S. Cl.
CPC . *F41A 3/66* (2013.01); *F41A 3/20* (2013.01)

(58) Field of Classification Search
CPC ..... F41A 3/20; F41A 3/18; F41A 3/22
USPC ..... 89/185, 187.01; 42/16
See application file for complete search history.

(56) References Cited

U.S. PATENT DOCUMENTS 5,886,281 A * 3/1999 Kirstein ..... F41A 5/18 89/187.01
5,920,028 A 7/1999 Guhring et al.
2020/0049436 A1* 2/2020 Braceras Devecchi ..... F41A 19/34

FOREIGN PATENT DOCUMENTS

DE 736 746 C 6/1943
DE 10 2018 114 381 A1 12/2019

OTHER PUBLICATIONS

Italian Search Report for Italian Patent Application No. 102021000026651 dated May 29, 2022, 2 pages.

* cited by examiner

*Primary Examiner* — Reginald S Tillman, Jr.
(74) *Attorney, Agent, or Firm* — Merchant & Gould P.C.

(57) ABSTRACT

A rifle has a fixed main body, including a barrel, a receiver with an upper opening, and a breech element. A trigger group is at least partially housed in the receiver, including a trigger and a hammer device operable by the trigger. A carriage assembly includes an assembly body and a shutter group at least partially housed in the assembly body. The carriage assembly is positioned on the receiver at the upper opening and is axially movable by a user between an advanced shooting configuration and a retracted rearming configuration. Upon axial movement of the carriage assembly, between the retracted and advanced configurations, the shutter group is first moved axially in translation and then in roto-translation. The shutter group includes a central body and a command pin protruding radially from the shutter body. The command pin engages the assembly body so reciprocal interaction guides the shutter group in rotation.

12 Claims, 15 Drawing Sheets

RIFLE WITH SHUTTER GROUP

This application claims the benefit of Serial No. 102021000026651, filed 18 Oct. 2021 in Italy and which application is incorporated herein by reference. To the extent appropriate, a claim of priority is made to the above disclosed application.

BACKGROUND OF THE INVENTION

The present invention relates to a rifle.

In particular, the present invention relates to a rifle preferably, but not necessarily, for hunting.

In still further detail, the rifle which is the object of the present invention is of the type wherein the rearming operations are performed by the user by manually axially moving the carriage assembly.

In the prior art, rifles with the aforementioned characteristics and operating methods are known.

In particular, there are known embodiments of rifles comprising a fixed main body grippable by the user, and a carriage assembly that is manually movable by the user in order to rearm the shot. In particular, in such rifles, the carriage assembly is known to move between an advanced and a retracted configuration and vice versa. Preferably, such known rifle solutions comprise an arming lever, or arming bolt, graspable by the user to perform the aforementioned operations.

The known solutions of rifles of this type include, in the carriage assemblies, shutter groups, the movement of which involves bullet loading operations and case discharging operations. In particular, the shutter group is suitable for being subjected to axial translation and rotation operations.

Preferably, said rotary movement of the shutter group is obtained by virtue of the reciprocal interaction between the carriage assembly and specific fixed components comprised within the main body.

SUMMARY OF THE INVENTION

The purpose of the present invention is to provide a rifle solution that is an alternative to such known solutions of the prior art.

BRIEF DESCRIPTION OF THE DRAWINGS

In addition, further features and advantages of the invention will become clear from the description provided below of its preferred embodiments given as non-limiting examples in reference to the attached figures, wherein:

FIGS. 1*a*' and 1*b*' show side views of the rifle shown in FIGS. 1*a* and 1*b;*

FIGS. 6*a*, 6*b* and 6*c* respectively show a top view, a longitudinal sectional view and a cross-sectional view of the rifle in FIG. 6;

DETAILED DESCRIPTION OF THE PREFERRED EMBODIMENTS

Figures 1A, 1B:
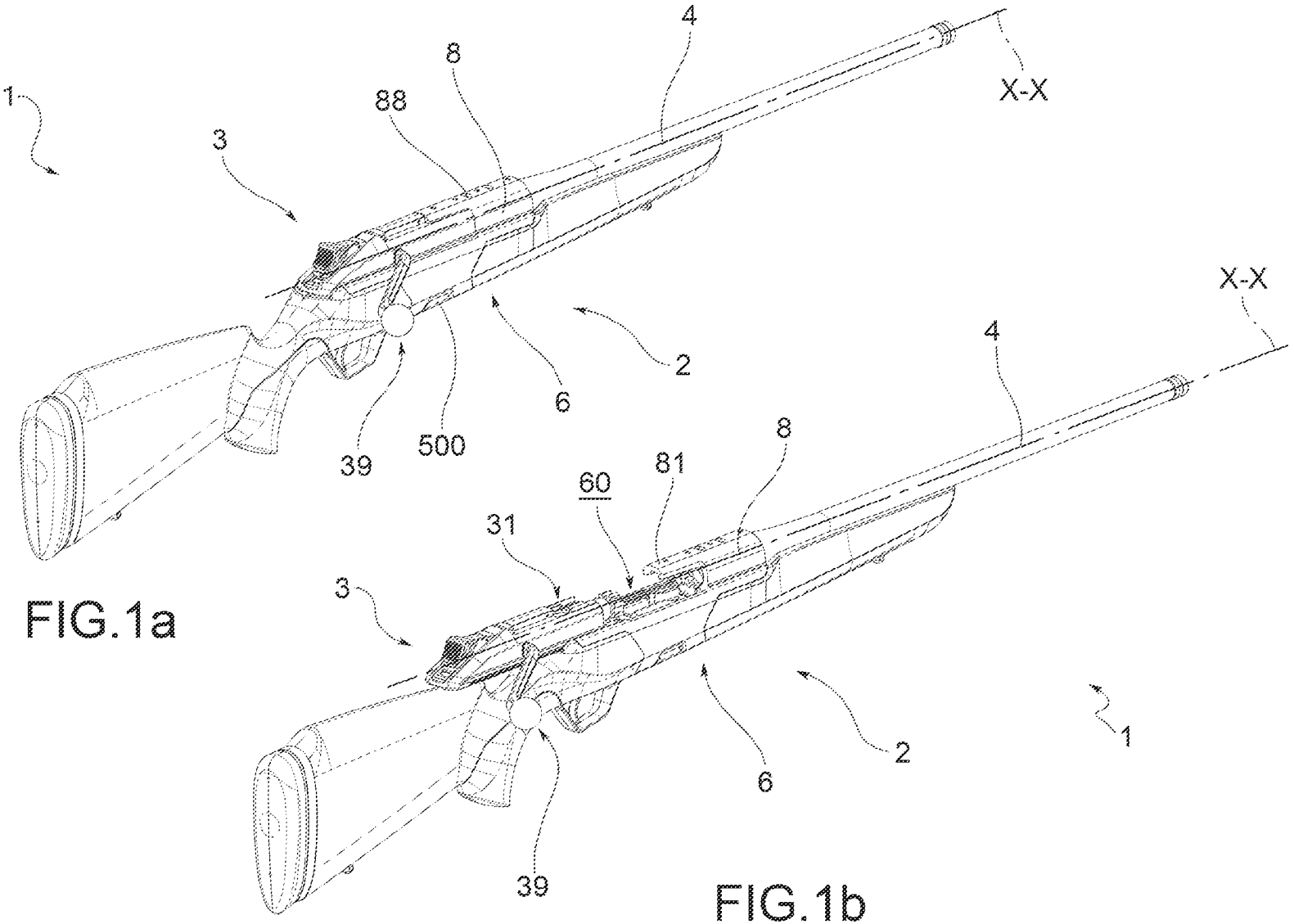
FIGS. 1*a* and 1*b* show perspective views of a rifle according to the present invention, wherein the carriage assembly comprised therein, according to a preferred embodiment, is in an advanced shooting configuration and in a retracted rearming configuration.
Figure 1A:
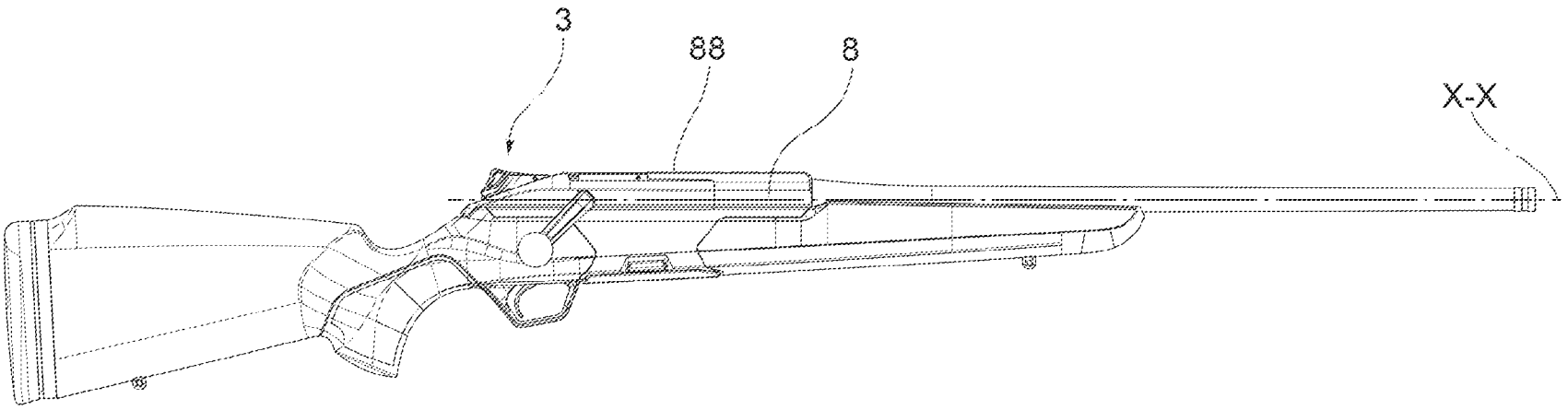
Figure 1B:
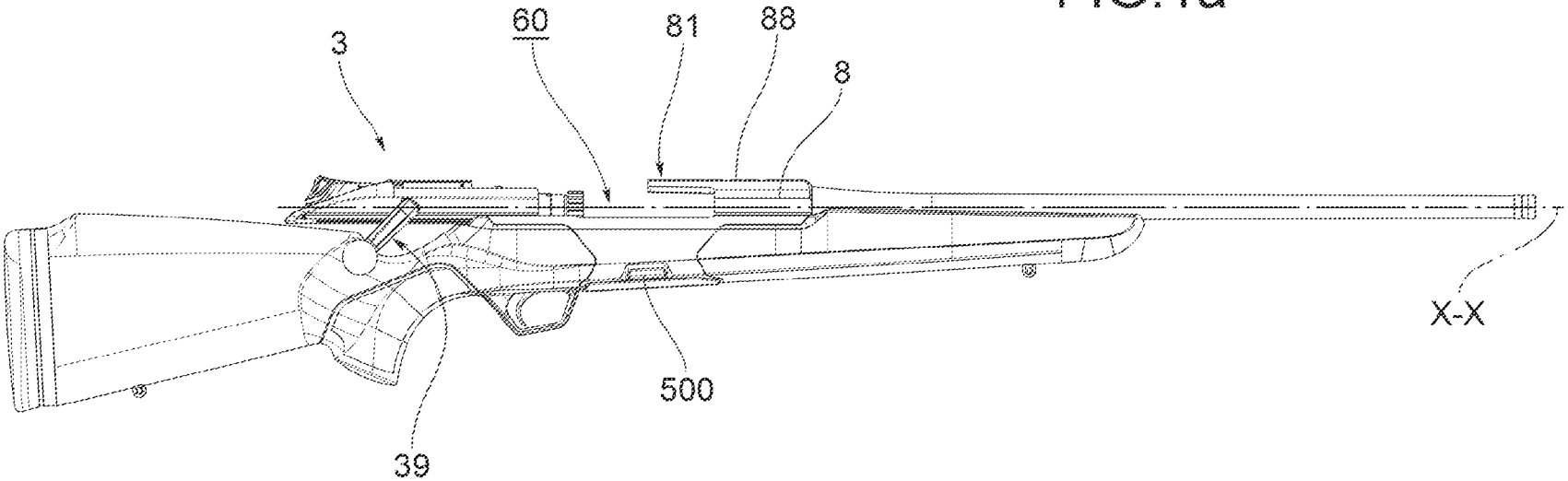
Figure 2:
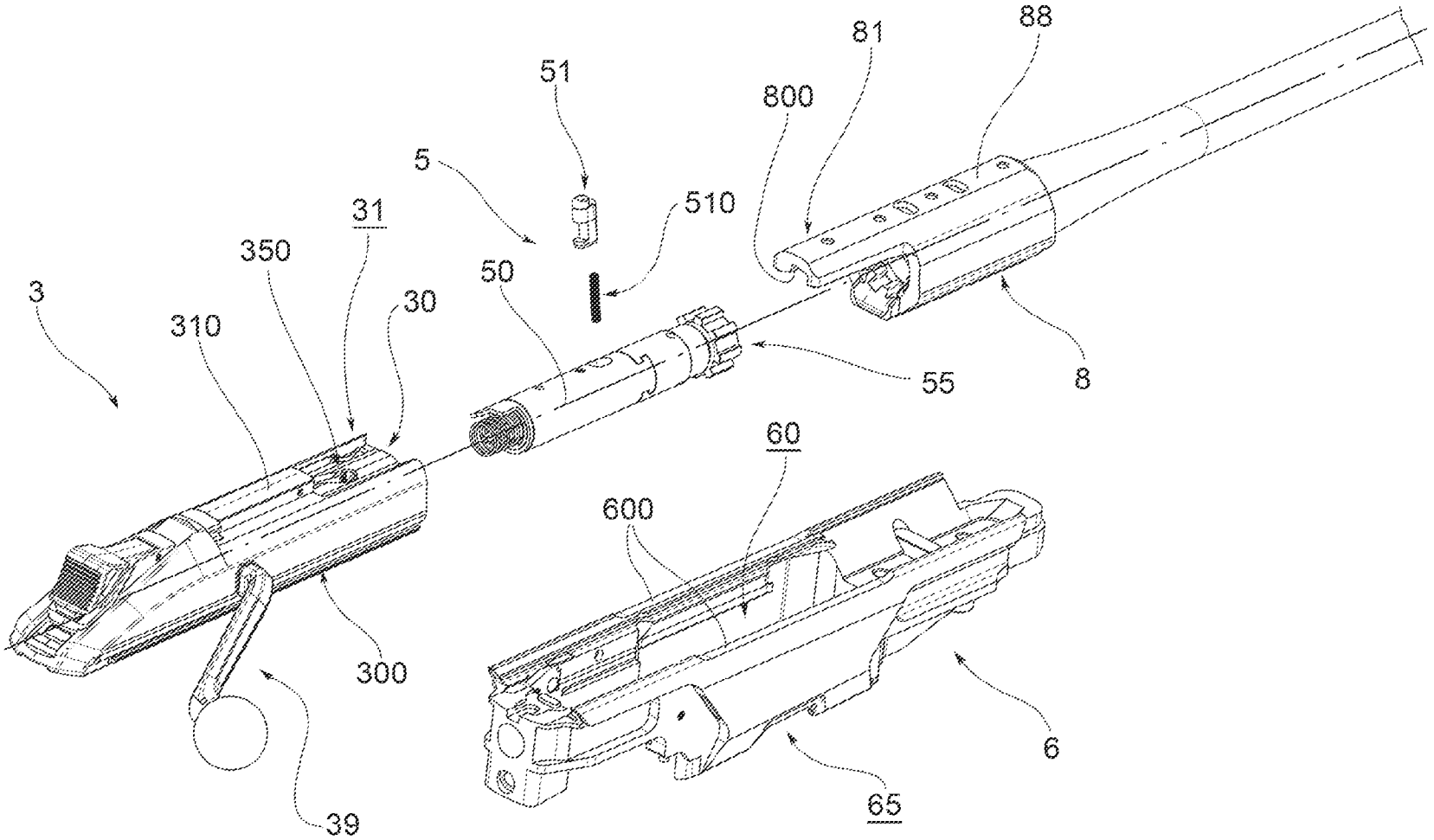
FIG. 2 shows a perspective view of separate parts of some components comprised within the rifle in FIGS. 1*a* and 1*b;*
Figure 3:
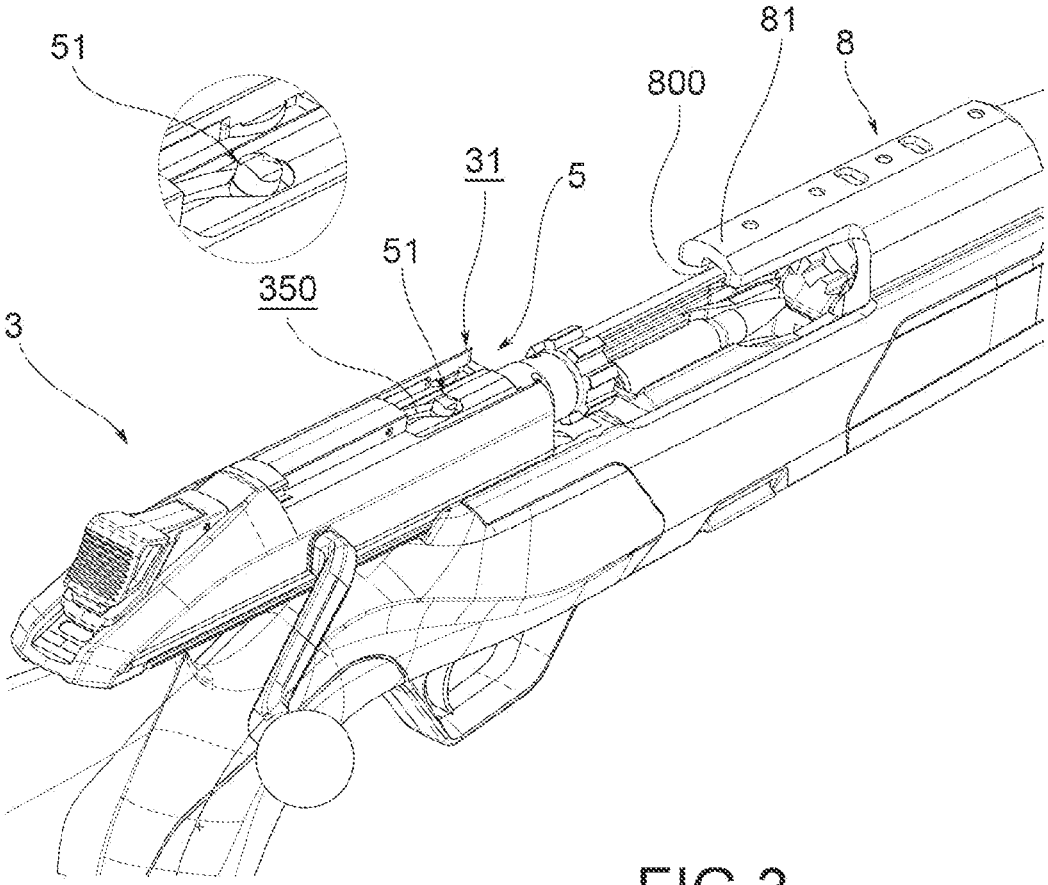
FIG. 3 shows an enlarged perspective view of the rifle which is the object of the present invention in a configuration with a retracted carriage assembly.
Figure 3A:
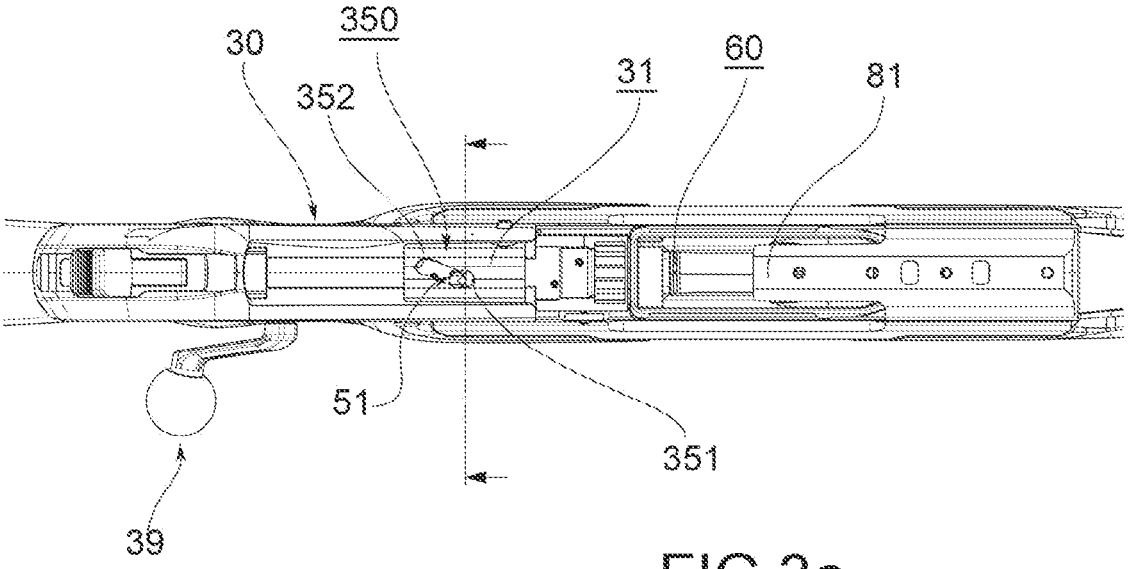
FIGS. 3*a*, 3*b* and 3*c* respectively show a top view, a longitudinal sectional view and a cross-sectional view of the rifle in FIG. 3*a;*
Figure 3B:
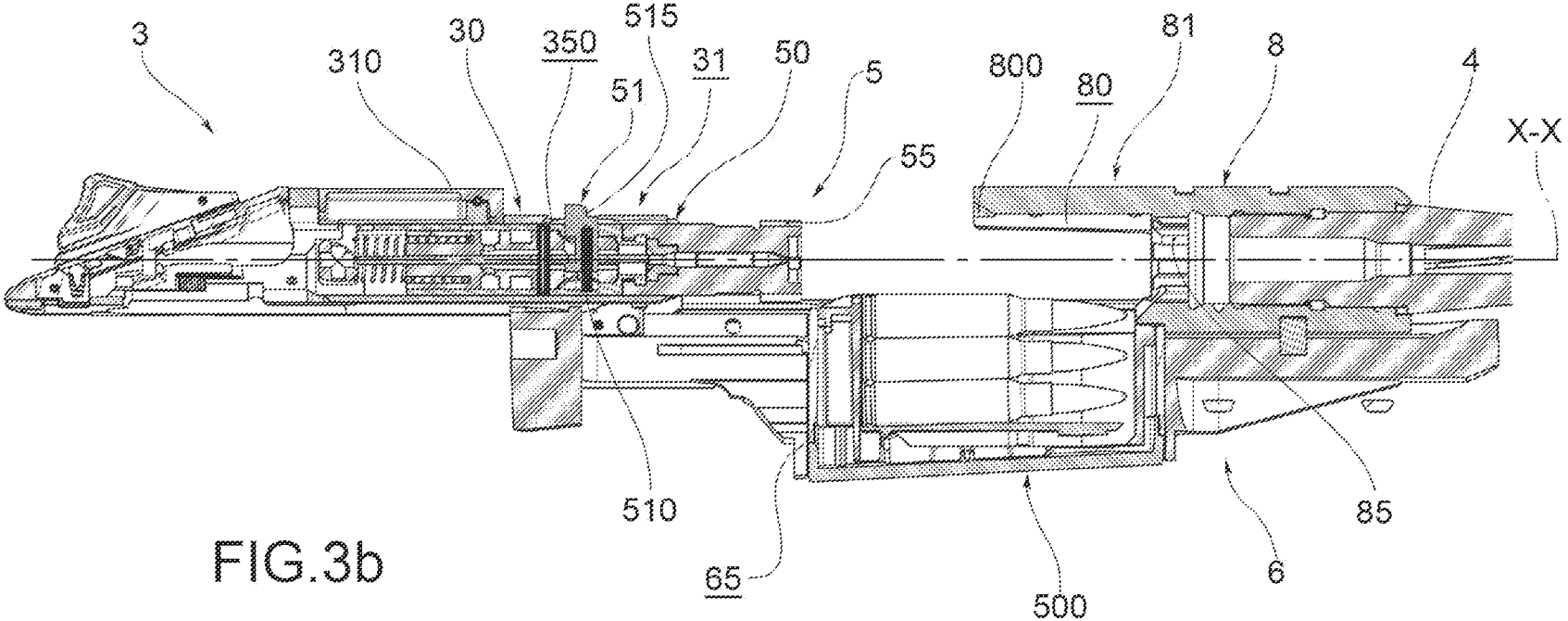
Figure 3C:
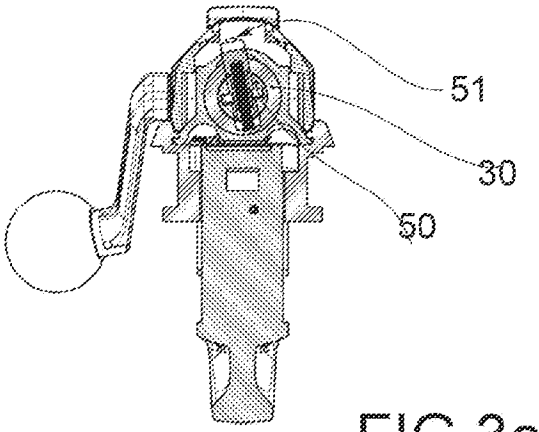
Figure 4:
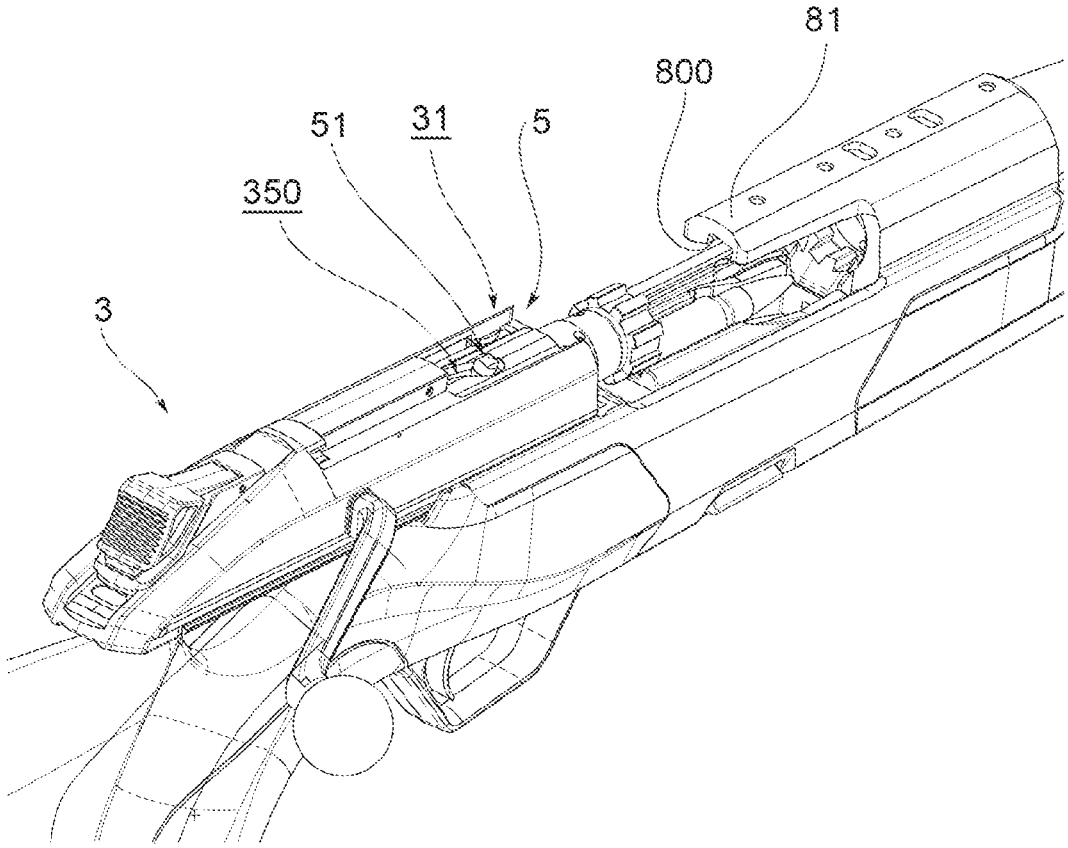
FIG. 4 shows an enlarged perspective view of the rifle which is the object of the present invention in a first intermediate configuration with a partially advanced carriage assembly.
Figure 4A:
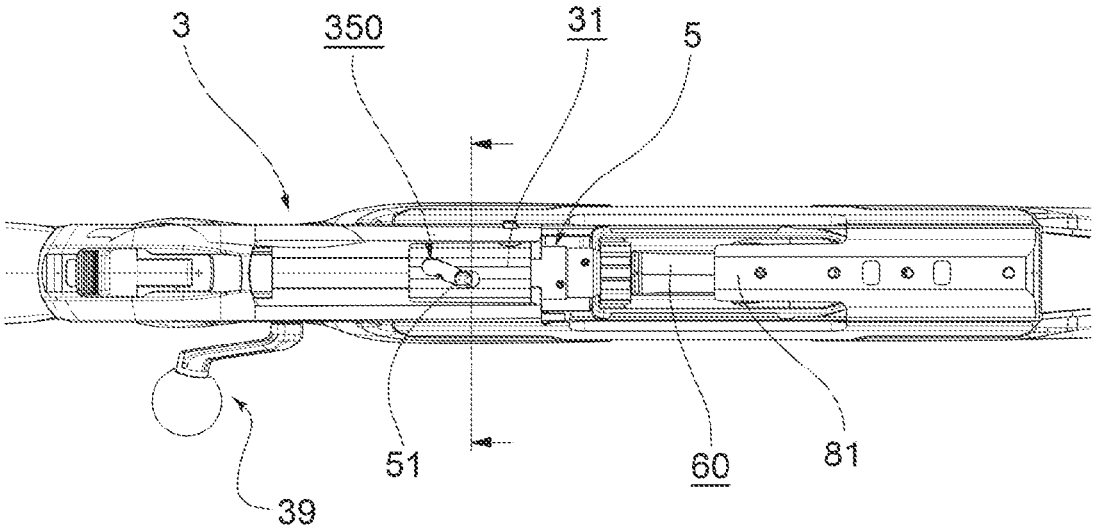
FIGS. 4*a*, 4*b* and 4*c* respectively show a top view, a longitudinal sectional view and a cross-sectional view of the rifle in FIG. 4.
Figure 4B:
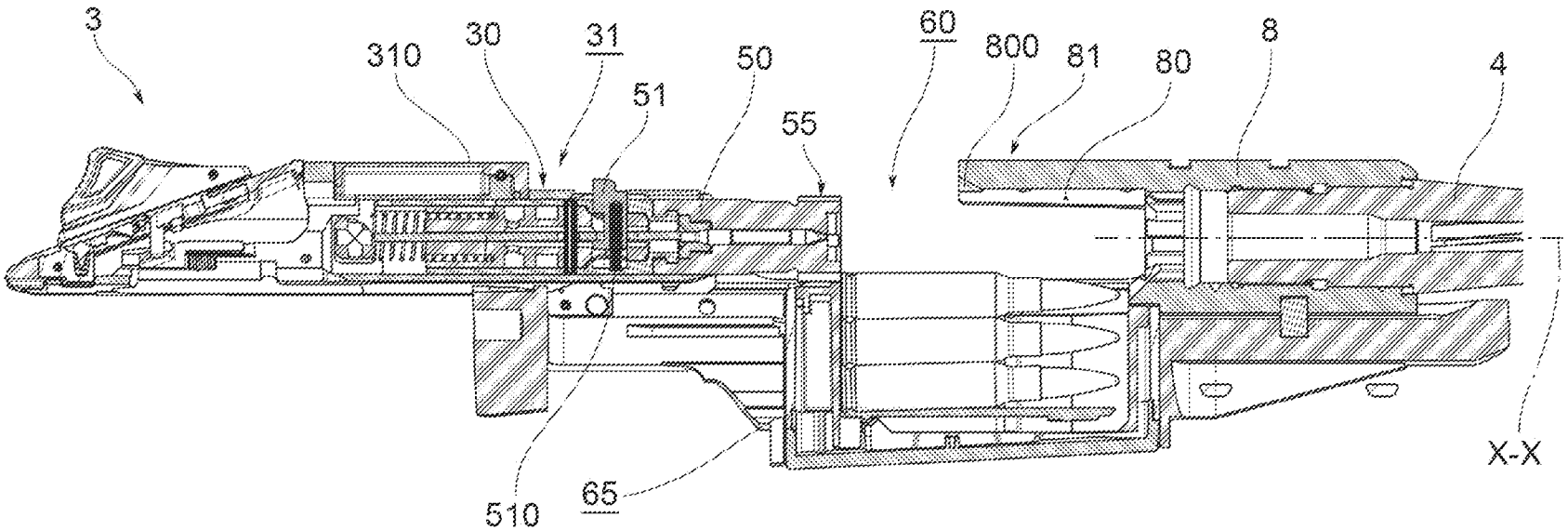
Figure 4C:
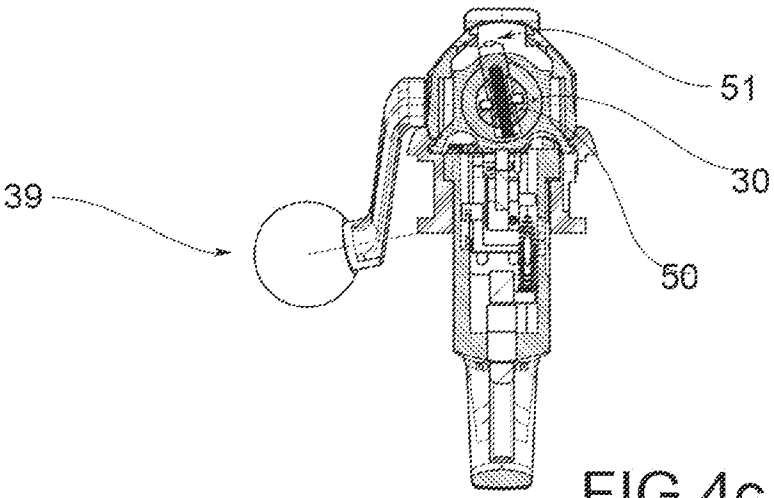
Figure 5:
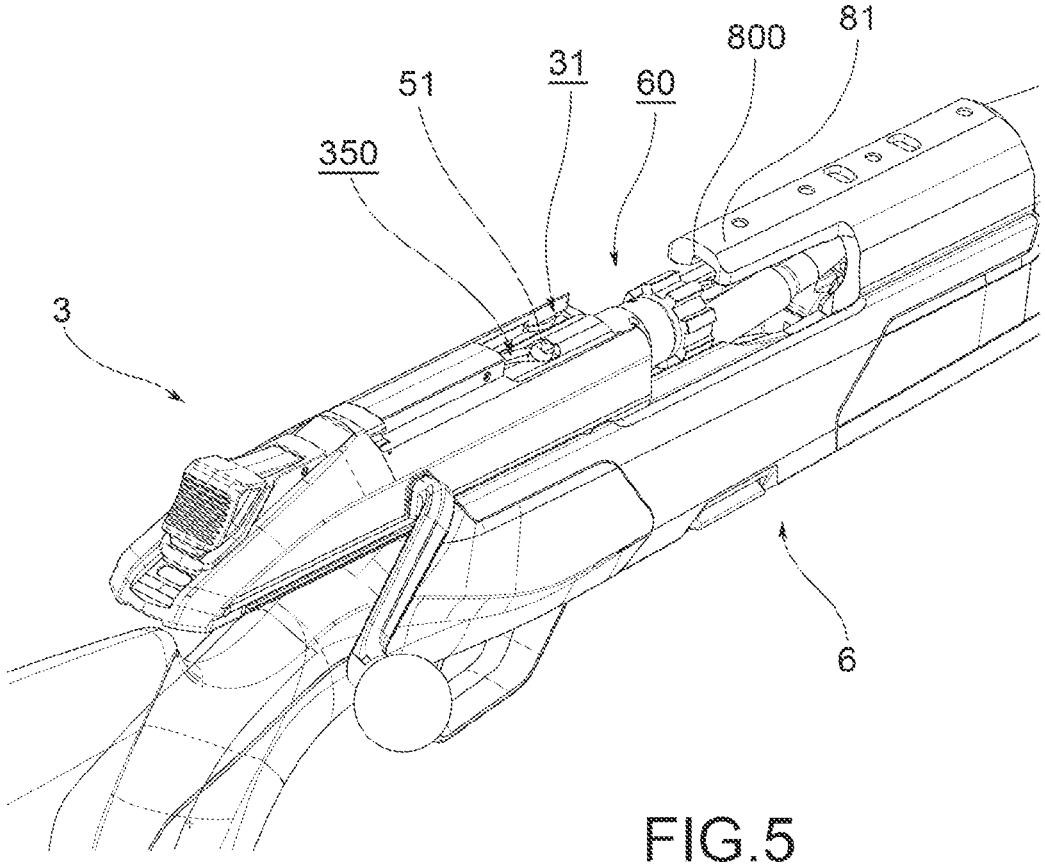
FIG. 5 shows an enlarged perspective view of the rifle which is the object of the present invention in a second intermediate configuration with a partially advanced carriage assembly.
Figure 5A:
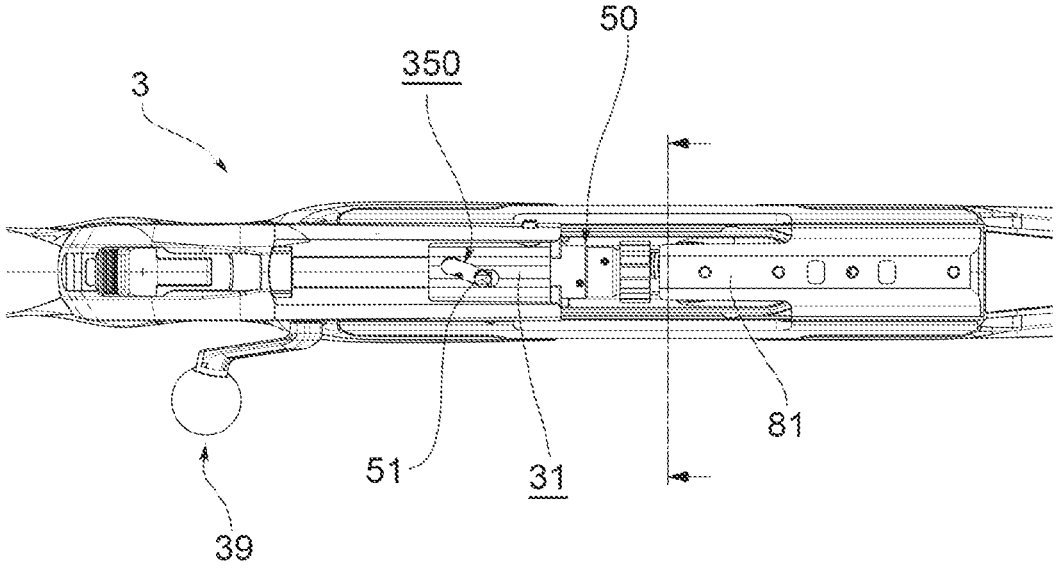
FIGS. 5*a*, 5*b* and 5*c* respectively show a top view, a longitudinal sectional view and a cross-sectional view of the rifle in FIG. 5.
Figure 5B:
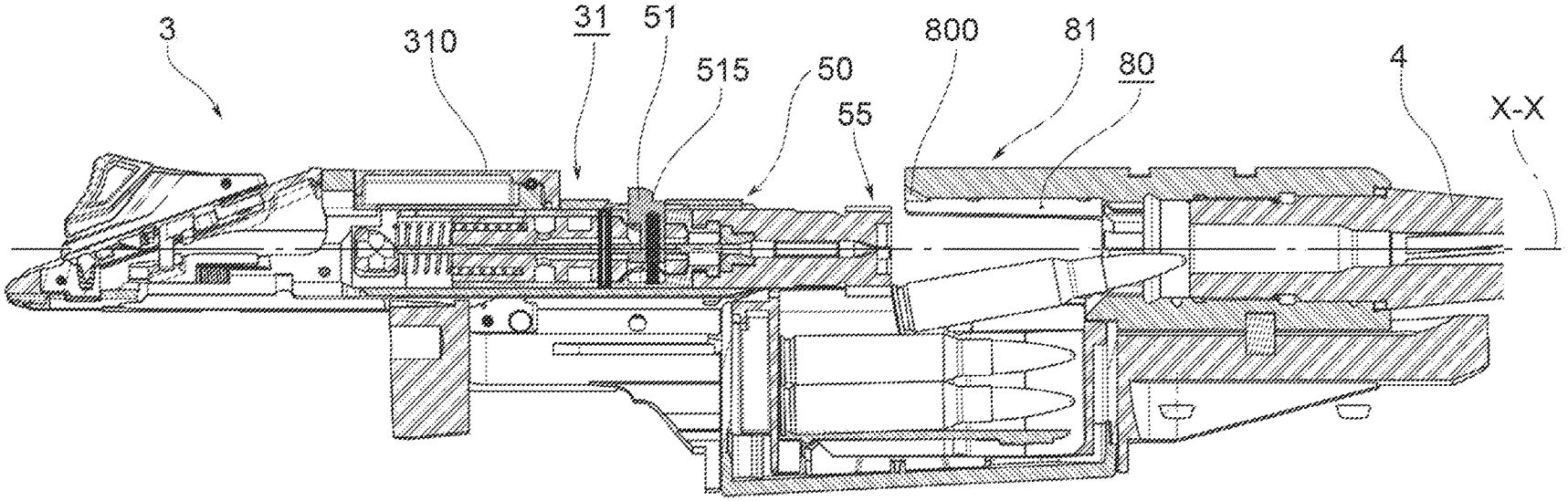
Figure 5C:
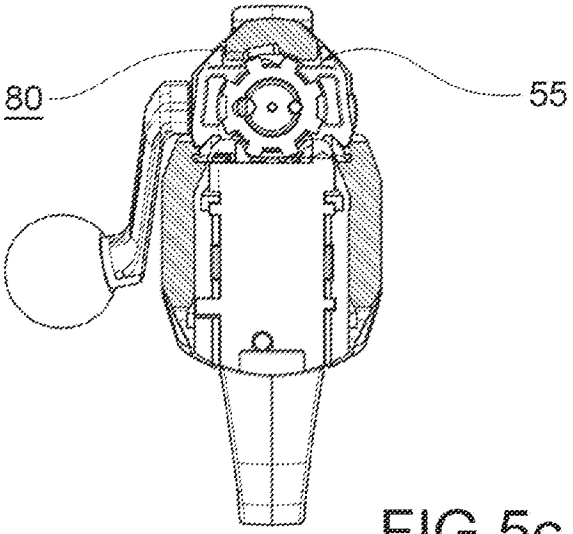
Figure 6:
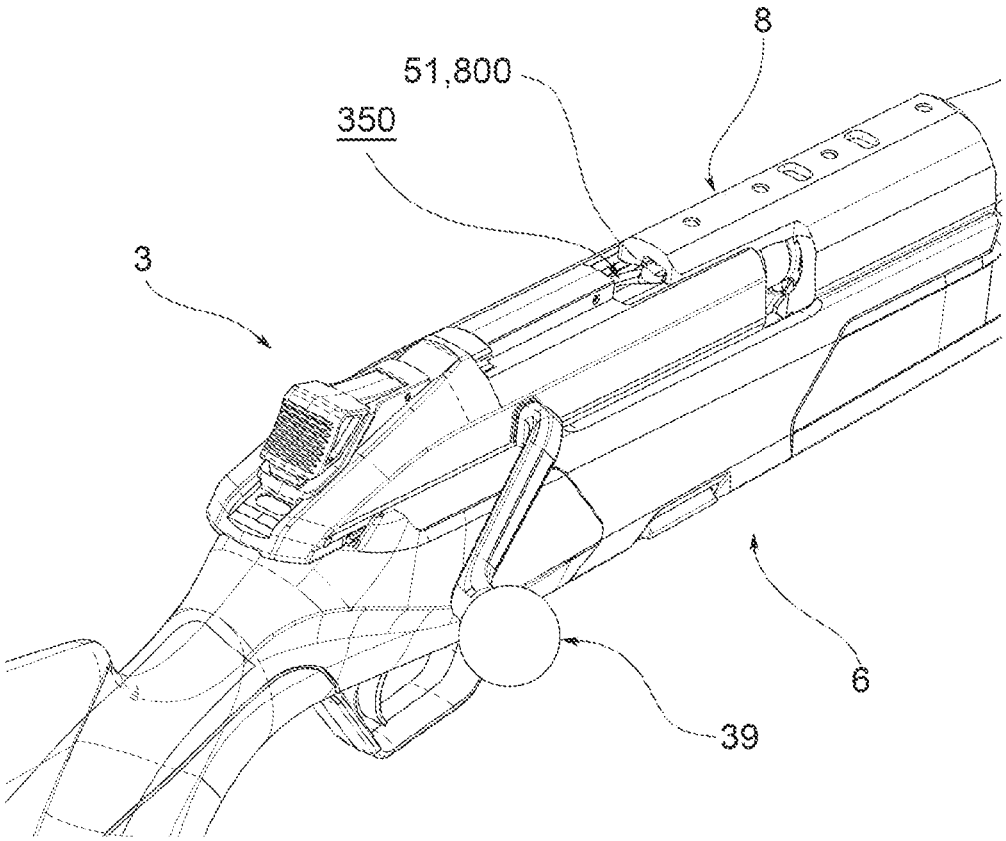
FIG. 6 shows an enlarged perspective view of the rifle which is the object of the present invention in a third intermediate configuration with a partially advanced carriage assembly.
Figure 6A:
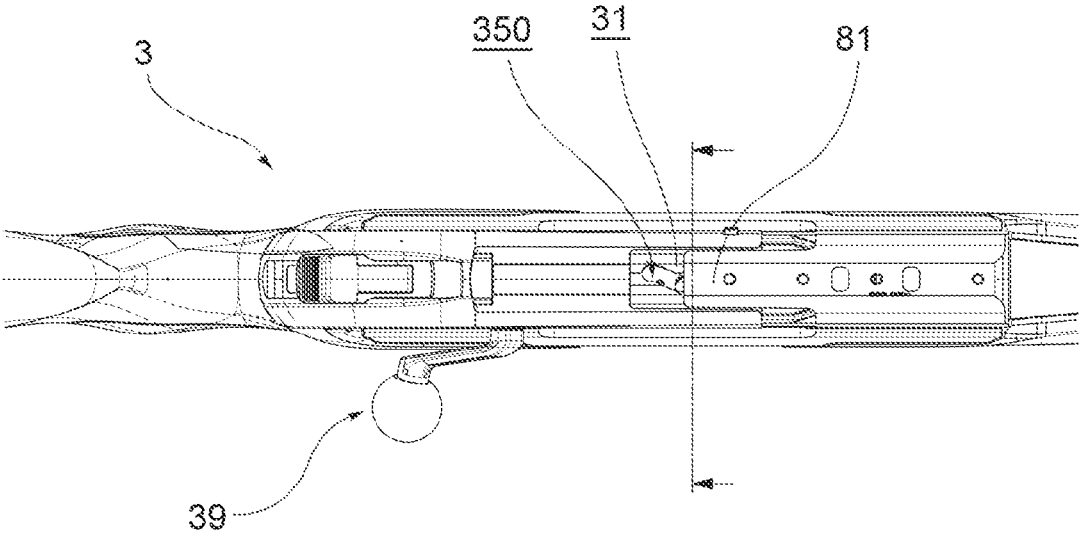
Figure 6A:
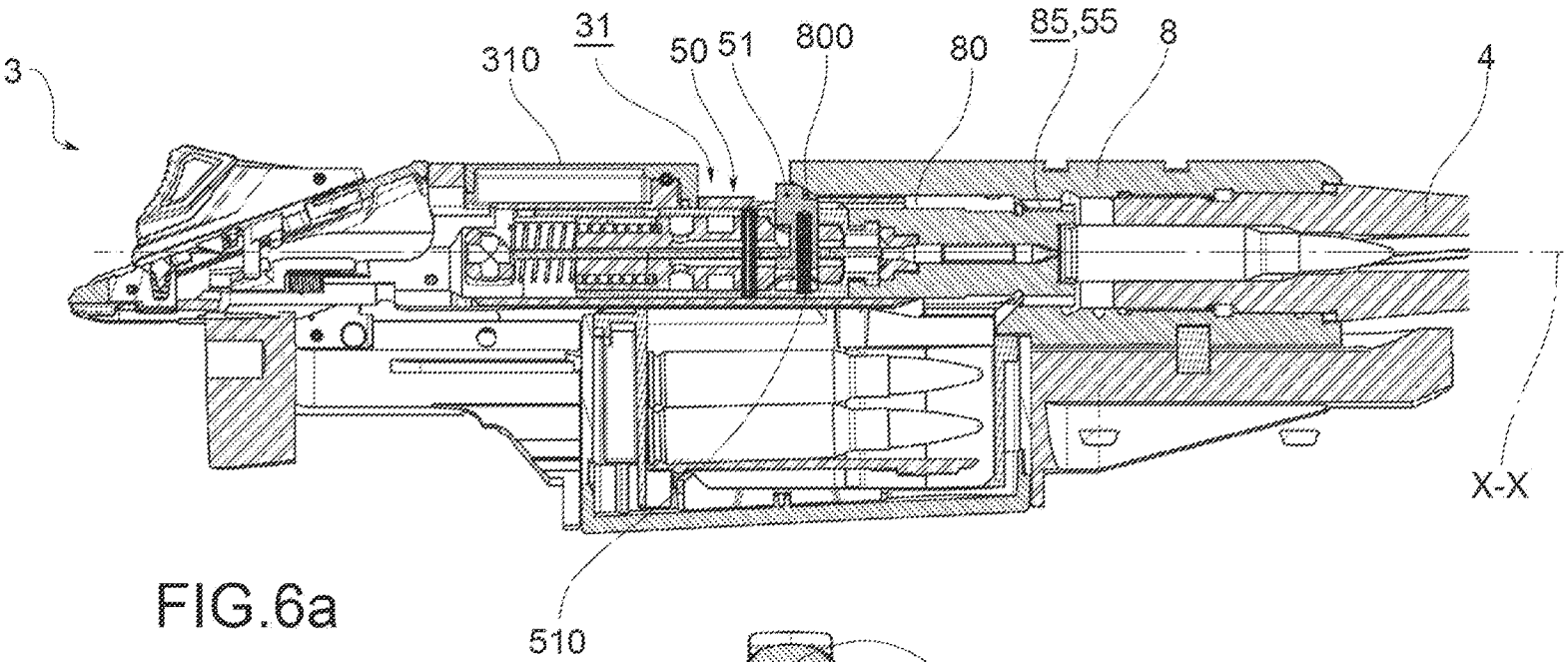
Figure 6B:
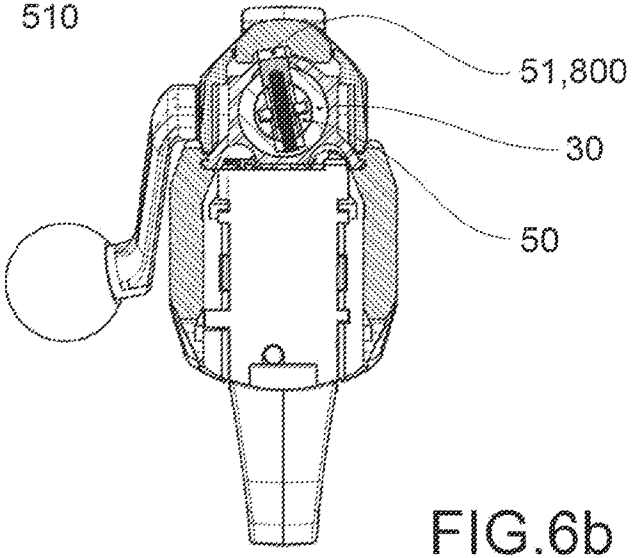

With reference to the accompanying figures, the number 1 denotes, in the entirety thereof, a rifle in accordance with the present invention.

The rifle 1 which is the object of the present invention comprises a plurality of components which, by convention, are defined as fixed, and a plurality of components which are defined as movable.

According to the present invention, the rifle 1 comprises a fixed main body 2.

Such a main body 2 is graspable or embraceable by the user for example in shooting or aiming operations, comprising a stock and/or a forend.

In accordance with the present invention, the fixed body 2 comprises a barrel 4 extending along an axis X-X. The axis X-X is therefore the axis of the barrel.

Preferably, with reference to movements or to certain characteristics or components, "axial" refers to movements or characteristics or components that occur or that are positioned parallel to said axis X-X, i.e., parallel to the barrel 4. In some cases such movements or features or components are along the barrel axis X-X. As an alternative to the term "axial", the term "longitudinal" is also used.

According to the present invention, the main body 2 comprises a receiver 6.

Preferably, the receiver 6 is made from a material belonging to the family of metals or metal alloys, or polymers, or polymeric materials, or composite materials.

In accordance with the present invention, the receiver 6 has an upper opening 60.

In other words, the receiver 6 has an opening 60 facing in the vertical direction.

In other words, the receiver 6 is a receiver "without a castle".

The receiver 6 is a hollow component that is suitable for containing components, shooting mechanisms, and bullets.

Preferably, the barrel 4 extends from the receiver 6.

Preferably, the stock extends from the receiver 6.

Preferably, the forend extends from the receiver 6.

Preferably, the receiver 6 also comprises a lower opening 65. The bullets enter through said lower opening 65. Preferably, a magazine 500 is housed inside the receiver 6. Preferably, the magazine 500 is inserted through said lower opening 65. Preferably, the magazine 500 closes said lower opening 65.

According to a preferred embodiment, the main body 2 also comprises a breech element 8 positioned at an axial end of said upper opening 60.

According to a preferred embodiment, the breech element 8 extends in height, preferably in a vertical direction.

Preferably, the barrel 4 is mountable onto the breech element 8 at an end opposite the firing mouth of the barrel 4.

In accordance with a preferred embodiment, the breech element 8 is comprised within the barrel 4: the breech element 8 is the axial end opposite the firing mouth of the barrel 4.

In accordance with a preferred embodiment, the aforementioned components, listed in a non-limiting manner, that form part of the main body 2 are all reciprocally distinct components.

In accordance with an embodiment variant, the aforementioned components, listed in a non-limiting way, that form part of the main body 2 are sometimes reciprocally connected: some components are reciprocally and integrally connected together.

According to the present invention, the rifle 2 comprises a trigger group 10 operable by the user in order to perform the shooting action.

The trigger group 10 is at least partially housed in the receiver 6.

Preferably, the trigger group 10 comprises a trigger 100 and a hammer device actionable by the trigger 100.

In accordance with the present invention, the rifle 1 comprises a carriage assembly 3 comprising a shutter group 5.

In accordance with a preferred embodiment, the shutter group 5 also comprises striker members engageable by the actioned hammer device 110.

More generally, the carriage assembly 3 comprises components, the movements and actuations of which involve a shooting action and a reloading action, i.e., discharging the exploded case to the outside and loading the bullet from the magazine 500.

In accordance with the present invention, the carriage assembly 3 is positioned on the receiver 6 at the upper opening 60.

According to a preferred embodiment, the carriage assembly 3 is positioned and is shaped in a suitable way to close said upper opening 60.

Preferably, the carriage assembly 3 slides on the axial edges 600 delimiting the upper opening.

In accordance with a preferred embodiment, the carriage assembly 3 comprises an assembly body 30 comprising special guides 300 suitable for sliding on said axial edges 600.

In accordance with the present invention, the carriage assembly 3 is movable by the user axially between an advanced shooting configuration and a retracted rearming configuration, and vice versa.

Preferably, the carriage assembly 3 comprises an arming handle 39, or an arming lever, or an arming bolt, graspable by the user in order to perform the aforementioned operations.

In accordance with the present invention, in the advanced or shooting configuration, the shutter group 5 engages with the breech element 8 in completely closing the upper opening 60. In said advanced configuration, the rifle 1 is then ready to perform the shooting action, acting with the trigger group 10, in particular with the hammer device 110 engaging with the shutter group 5, in particular the striker members.

In accordance with the present invention, in the retracted rearming configuration, the carriage assembly 3 is positioned such that the upper opening 60 is open. In other words, the upper opening 60 is accessible from above. Preferably, the upper opening 60 is accessible from both the top and the sides.

In the retracted configuration, the rifle 1 has discharged the case, and is ready to be returned to the advanced shooting configuration. With said movement, the carriage assembly 3 is therefore suitable for reloading a bullet that may then be subjected to the shooting action.

In accordance with the present invention, the carriage assembly 3 comprises an assembly body 30. The shutter group 5 is housed within said assembly body 30.

In accordance with the present invention, the carriage assembly 3 is moved by the user and the shutter group 5 is guided in movement by the carriage assembly 3: the shutter group 5 is guided in movement together with the assembly body 30 in relation to the receiver 6 and is guided in movement in relation to the assembly body 30.

Specifically, in accordance with the present invention, upon the axial movement of the carriage assembly 3, between the retracted configuration and the advanced configuration, the shutter group 5 is first moved axially in translation and then moved in roto-translation.

Preferably, upon the axial movement of the carriage assembly 3, between the advanced configuration and the retracted configuration, the shutter group 5 is first moved in roto-translation and then moved axially in translation.

According to a preferred embodiment, the axial translation movement of the shutter group 5 is simultaneous with the axial translation movement of the body assembly 30.

Preferably, the roto-translation movement of the shutter group 5 takes place with respect to the movement of the assembly body 30 in axial translation.

According to a preferred embodiment, the roto-translating action begins with the shutter assembly 5 abutting against the barrel 4 and/or against the breech element 8.

Figure 7:
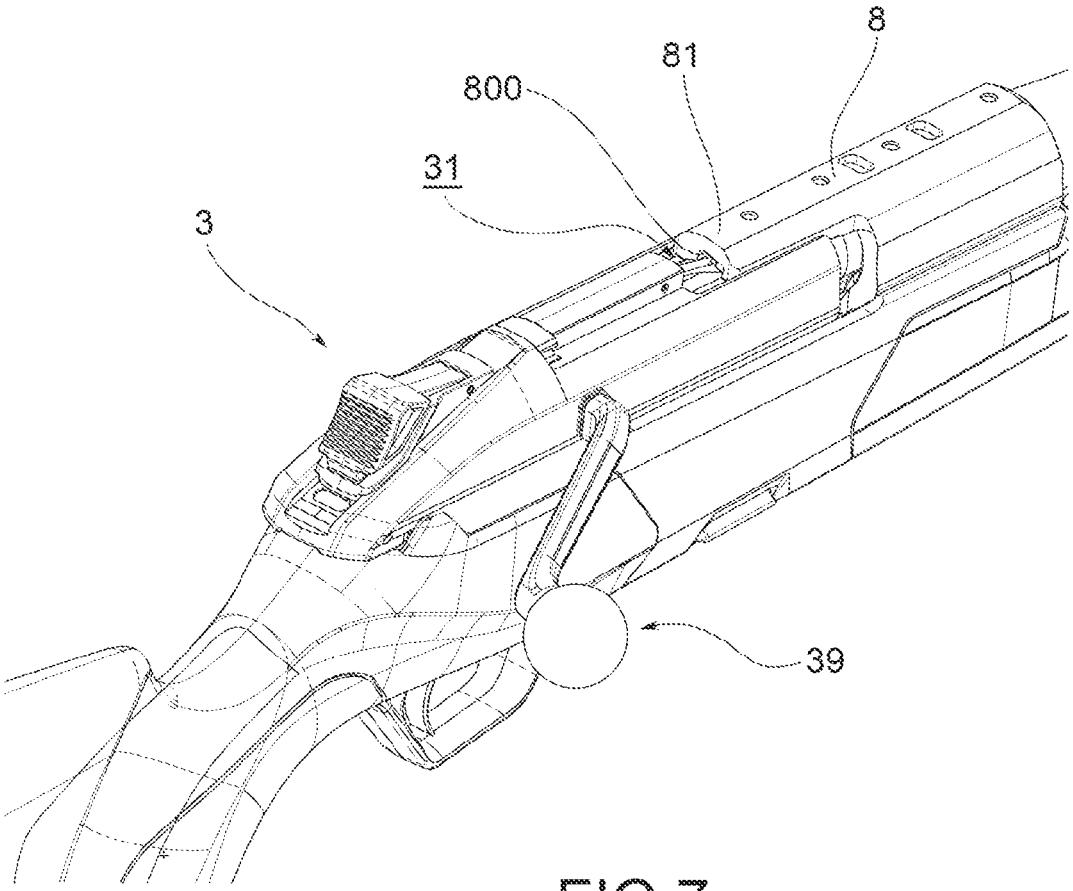
FIG. 7 shows an enlarged perspective view of the rifle which is the object of the present invention in a fourth intermediate configuration with the carriage assembly in an axially advanced position and with the shutter group not rotated.
Figure 7A:
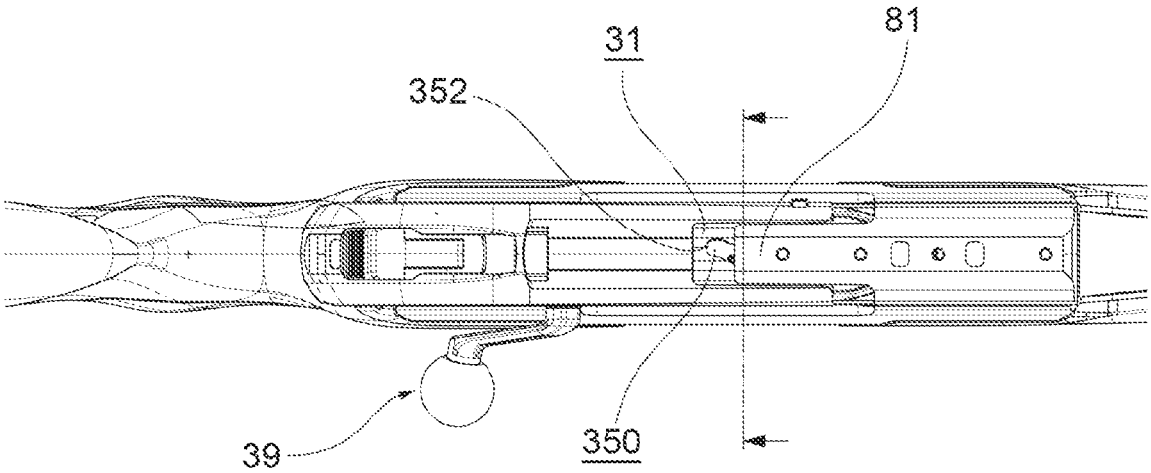
FIGS. 7*a*, 7*b* and 7*c* respectively show a top view, a longitudinal sectional view and a cross-sectional view of the rifle in FIG. 7.
Figure 7B:
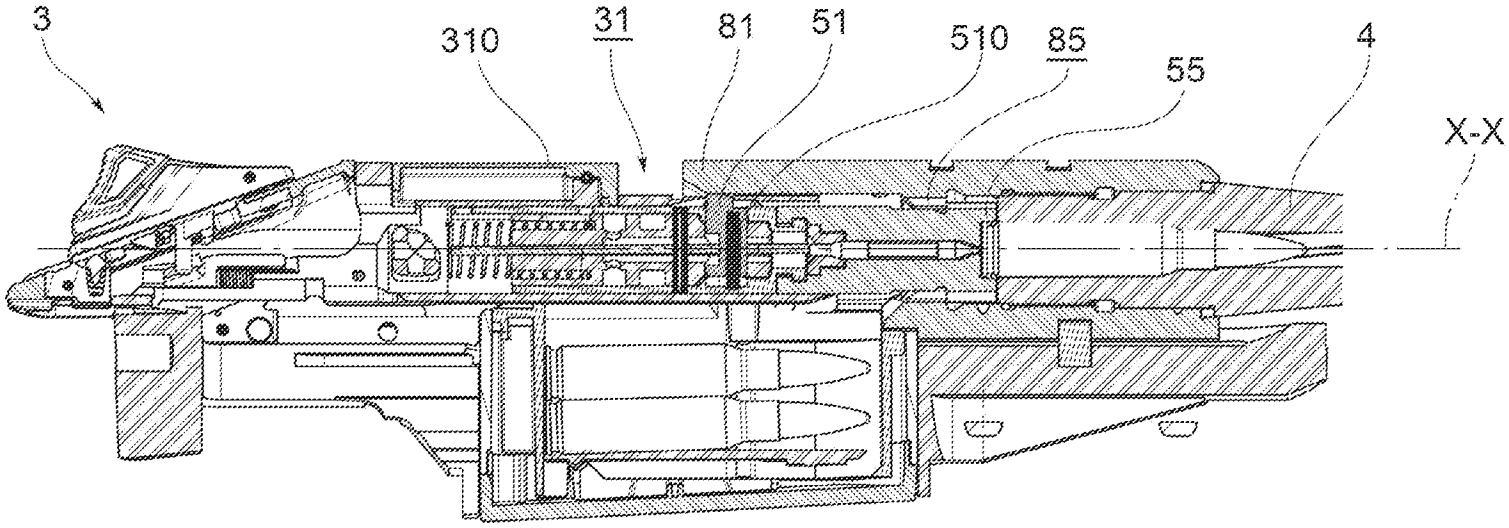
Figure 7C:
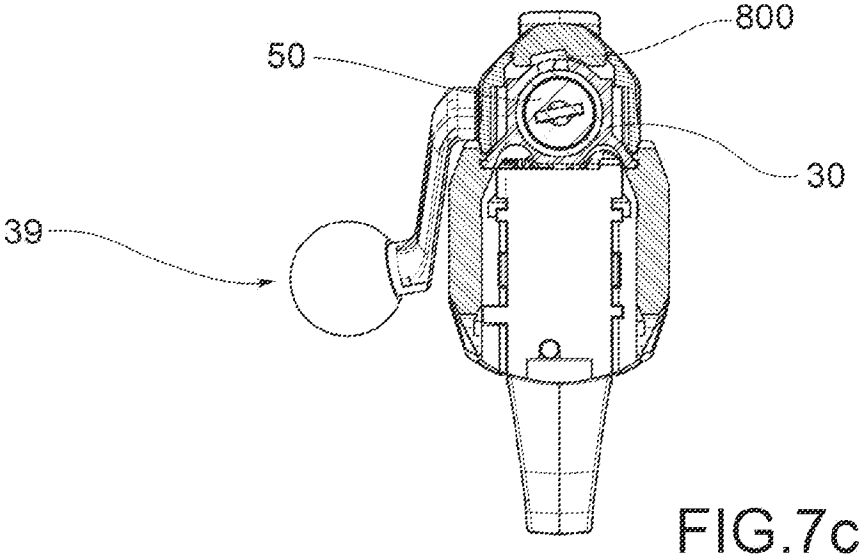

In particular, in the accompanying figures, shown by way of example, as in FIGS. 3, 4, 5, 6 and 7, is the axial advancement of the carriage assembly 3, and therefore of the body assembly 30 and of the shutter group 5, the latter being angularly fixed in an angular starting position. In FIG. 7, it is evident how the shutter group 5 is abutting against the barrel 4.

Figure 8:
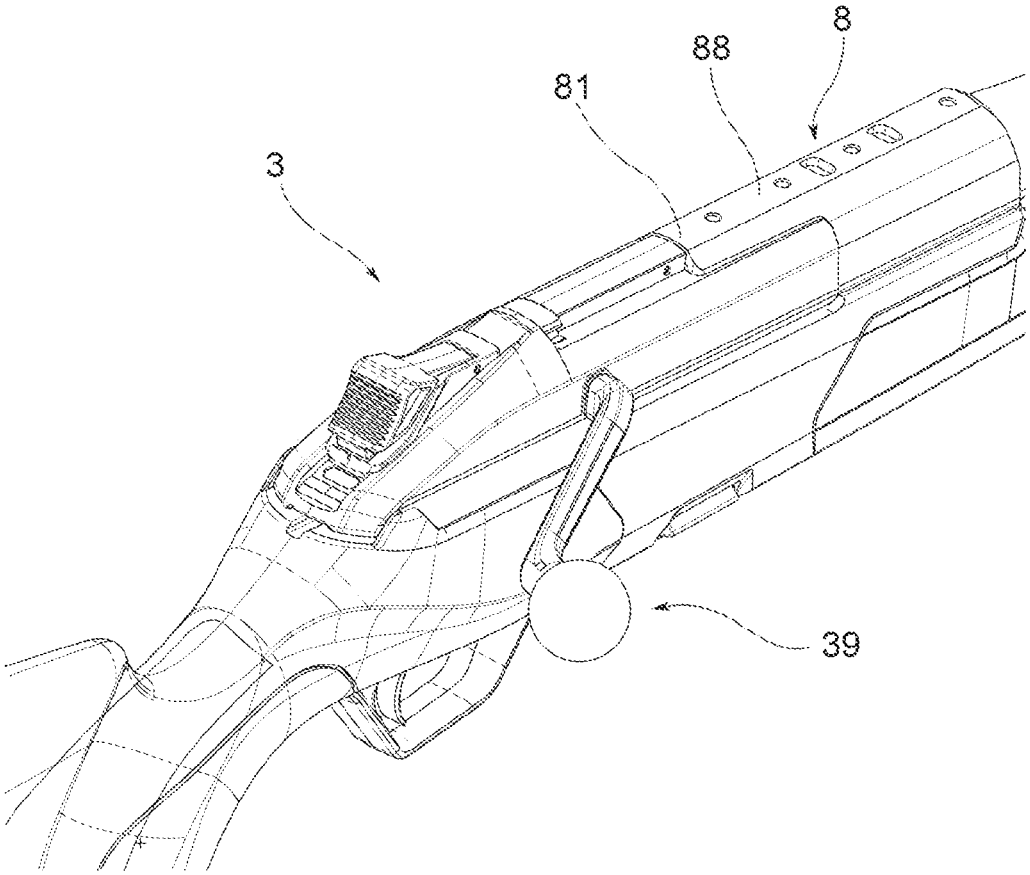
FIG. 8 shows an enlarged perspective view of the rifle which is the object of the present invention in an advanced shooting configuration of the carriage assembly, wherein the shutter group is rotated.
Figure 8A:
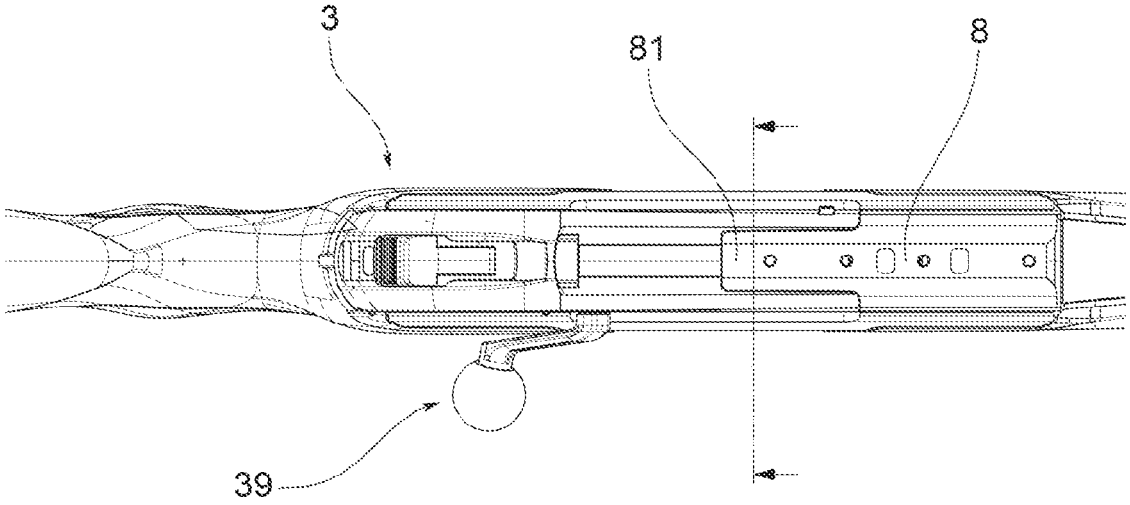
FIGS. 8*a*, 8*b* and 8*c* respectively show a top view, a longitudinal sectional view and a cross-sectional view of the rifle in FIG. 8.
Figure 8B:
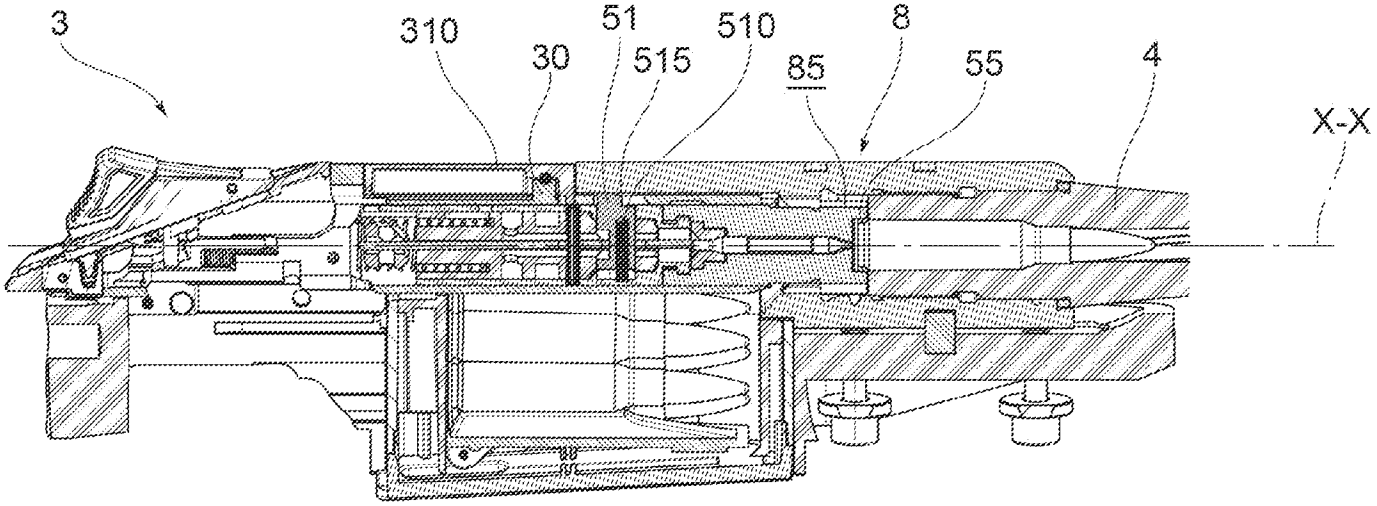
Figure 8C:
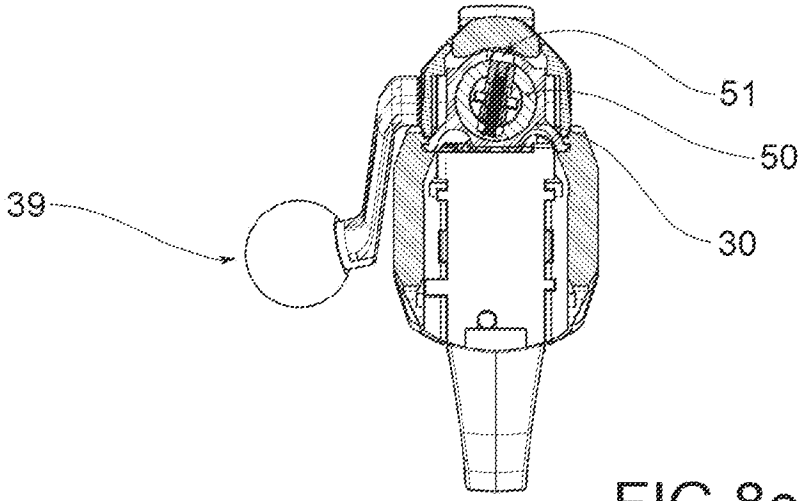

FIG. 8 shows, by way of example, the last axial section of advancement of the carriage assembly 3, in particular of the assembly body 30, while the shutter group 5 is rotated with respect to said assembly body 30, being in a new angular position and in an axial position that is further retracted with respect to the assembly body.

According to a preferred embodiment, the shutter group 5 comprises a central body 50 which extends axially.

Preferably, said central body 50 is substantially axisymmetric.

Preferably, said central body 50 has a substantially cylindrical shape.

According to a preferred embodiment, the shutter group 5 comprises a shutter head 55 integrally connected to the central body 50 and commandable in rotation therewith.

Preferably, the shutter head 55 is suitable for being operated with the bullet during the advancing operations of the carriage assembly 3 and during the retraction operations.

In accordance with a preferred embodiment, the shutter head 55 is suitable for performing the operations of discharging the case and loading the bullet. In particular, the shutter head 55 is shaped in such a way to perform the operations of discharging a case to one side of the rifle.

According to a preferred embodiment, the shutter head 55 is shaped in such a way as to enter axially within the breech element 8 through a breech element opening 85 with a complementary shape.

Preferably, the rotated shutter head 85 is axially locked by means of specific portions of the breech element opening 85.

In accordance with the present invention, the shutter group 5 comprises a command pin 51 that protrudes radially from said shutter body 50.

In accordance with the present invention, the command pin 51 engages with the assembly body 30 in such a way that said reciprocal interaction guides the shutter group 5 in rotation.

According to the present invention, the command pin 51 protrudes radially, engaging with the assembly body 30.

Preferably, the command pin 51 is housed in a command cavity 350.

According to a preferred embodiment, the shape of said command cavity 350 guides the movement of the command pin 51 and the relative rotation of the shutter group 5 with respect to the assembly body 30.

Preferably, the command cavity 350 comprises two end end-stops 351, 352 corresponding to the two angular end positions of the shutter group 5 with respect to the assembly body 30.

In accordance with a preferred embodiment, with the advancing movement of the carriage assembly 3, the shutter body 50 is rotated in one direction, preferably clockwise, while with the retraction movement of the carriage assembly 3, the shutter body 50 is rotated in the opposite direction, preferably counterclockwise.

According to a preferred embodiment, the shutter head 55 is positioned at an angular starting position and an angular shooting position depending upon the position of the command pin 51. Preferably, said positions are discrete positions, it being possible to replicate them, with certainty, over time. Preferably, the shutter head 55 is positioned at an angular starting position corresponding to the retracted configuration of the carriage assembly 3 and at an angular shooting position corresponding to the advanced configuration of the carriage assembly 3.

According to a preferred embodiment, the command pin 51 is movable between a raised position and a lowered position.

Furthermore, according to a preferred embodiment, the shutter group 5 comprises an elastic element 510 that is suitable for keeping the command pin 51 raised.

In accordance with a preferred embodiment, in said raised position, the command pin 51 prevents the relative movement of the shutter group 5 with respect to the assembly body 3.

Preferably, the command pin 51 comprises a shaped head end comprising a step 515.

With the command pin 51 in the raised position, said step 515 houses within the command cavity 350 and inhibits the relative sliding of the shutter group 5 with respect to the carriage assembly 3.

According to a preferred embodiment, with the command pin 51 in the lowered position, the step 515 is housed in the shutter body 50 and the pin is thus free to slide into the command cavity 350.

In accordance with a preferred embodiment, the command pin 51 is engageable by the breech element 8.

Preferably, during the engagement of the command pin 51 with the breech element 8, the command pin 51 is moved vertically. Preferably, during the engagement of the command pin 51 with the breech element 8, the command pin 51 is lowered. Preferably, during the disengagement of the command pin 51 from the breech element 8, the command pin 51 is raised.

According to a preferred embodiment, the breech element 8 comprises an inclined plane 800, wherein said command pin 51 slides on said inclined plane 800 with an axial movement and is moved vertically.

Preferably, the breech element 8 comprises a sliding cavity 80 extending axially in length.

According to a preferred embodiment, during the advancement of the carriage assembly 3, the command pin 51 is firstly the object of a radial movement and subsequently of a rotary movement.

Conversely, according to a preferred embodiment, during the retraction of the carriage assembly 3, the command pin 51 is firstly the object of a rotary movement and subsequently of a radial movement.

According to a preferred embodiment, the shutter group 5 extends axially in length within the assembly body 30: the shutter group 50 is housed substantially entirely in the assembly body 30, while the shutter head 55 protrudes axially therefrom.

Preferably, the command pin 51 protrudes outwardly through the assembly body 30 through the aforementioned command cavity 350.

According to a preferred embodiment, the command pin 51 protrudes vertically from the assembly body 30, preferably radially with respect to the axial direction.

According to a preferred embodiment, the amplitude of the rotary movement of the shutter group 5 is due to the length and shape of the passage opening 350.

Preferably, the command pin 51 slides engaging the edges of the command cavity 350.

According to a preferred embodiment, the breech element 8 comprises an axially protruding portion 81 and the carriage assembly 3 comprises an axially hollow portion 31 specially shaped to house the axially protruding portion 81. Preferably, the axially protruding portion 81 and the axially hollow portion 31 are shaped in such a way that they are complementary to one another. In the advanced shooting configuration, the axially projecting portion 81 is housed in the axially hollow portion 31.

According to a preferred embodiment, the command pin 51 is positioned within said axially hollow portion 31.

According to a preferred embodiment, the passage opening 350 is formed at the axially hollow portion 31.

In accordance with a preferred embodiment, the carriage assembly 3 comprises a body cover 310 that fits over the body assembly 30. Preferably, the axially hollow portion 31 is formed in the body cover 310. Preferably, the passage opening 350 is formed in the assembly body 30.

In accordance with a preferred embodiment, specific accessories, such as a targeting group, mountable on the breech element 8 at the top 88 thereof.

Innovatively, the rifle which is the object of the present invention broadly fulfills the intended purpose thereof.

Advantageously, the rifle which is the object of the present invention is an alternative solution to those that are known.

Advantageously, the rifle which is the object of the present invention comprises a shutter group movable in a certain, replicable and reliable manner.

Advantageously, the rotary action on the shutter group is performed directly by the carriage assembly.

Advantageously, the interaction between the various components and kinematic mechanisms is extremely simplified and does not involve difficulties or the risk of jamming.

Advantageously, the rifle cleaning operations are extremely simplified. Advantageously, in the configuration with the carriage assembly retracted, there is ample access to the upper opening.

Advantageously, the movements of the shutter group with respect to the receiver are guided by the carriage assembly itself.

Advantageously, said movements are replicable over time, with the certainty that they are always identical one with the other.

Advantageously, the shutter assembly is locked in a defined angular position when necessary. Advantageously, the shutter group is not rotatable by the action of third components other than the command pin and the command cavity.

It is clear that a person skilled in the art may make changes to the invention described above in order to meet contingent needs, which changes all fall within the scope of protection as defined in the following claims.

The invention claimed is:

1. A rifle comprising:

i) a fixed main body, comprising a barrel which extends along an axis, a receiver comprising an upper opening, a breech element positioned at an axial end of said upper opening;

ii) a trigger group at least partially housed in the receiver comprising a trigger and a hammer device operable by the trigger;

iii) a carriage assembly, comprising an assembly body and a shutter group at least partially housed in said assembly body, wherein the carriage assembly is positioned on the receiver at the upper opening and is axially movable by a user between an advanced shooting configuration, in which the shutter group engages the breech element, and a retracted rearming configuration, in which the upper opening is open, and the shutter group is spaced apart from the breech element, and vice versa;

wherein, upon axial movement of the carriage assembly between the retracted configuration and the advanced configuration, the shutter group is first moved axially in translation and then is moved in roto-translation;

wherein the shutter group comprises a central body extending axially and a command pin protruding radially from said shutter body, wherein said command pin engages the assembly body so that said reciprocal interaction drives the shutter group in rotation; and wherein the command pin is movable between a raised position and a lowered position, in which, in said raised position, the command pin prevents relative movement of the shutter group with respect to the assembly body.

2. The rifle according to claim 1, wherein the roto-translational action starts with the shutter group abutting on the barrel and/or on the breech element.

3. The rifle according to claim 1, wherein the command pin protrudes radially engaging the assembly body, housing in a command cavity wherein a shape of said command cavity drives movement of the command pin and relative rotation of the shutter group with respect to the assembly body.

4. The rifle according to claim 3, wherein the command cavity comprises two end end-stops corresponding to two angular end positions of the shutter group with respect to the assembly body.

5. The rifle according to claim 1, wherein the command pin is movable in the command cavity only if positioned in the lowered position.

6. The rifle according to claim 1, wherein the shutter group comprises an elastic element configured for keeping the command pin in the raised position.

7. The rifle according to claim 1, wherein the breech element is configured for engaging the command pin to take the command pin from the raised position to the lowered position.

8. The rifle according to claim 7, wherein the breech element comprises an inclined plane, wherein said command pin slides on said inclined plane in the axial movement and is moved vertically.

9. The rifle according to claim 7, wherein the breech element comprises a sliding cavity extending axially lengthwise, wherein said command pin accommodates in said sliding cavity.

10. A rifle comprising:

i) a fixed main body, comprising a barrel which extends along an axis, a receiver comprising an upper opening, a breech element positioned at an axial end of said upper opening;

ii) a trigger group at least partially housed in the receiver comprising a trigger and a hammer device operable by the trigger;

iii) a carriage assembly, comprising an assembly body and a shutter group at least partially housed in said assembly body, wherein the carriage assembly is positioned on the receiver at the upper opening and is axially movable by a user between an advanced shooting configuration, in which the shutter group engages the breech element, and a retracted rearming configuration, in which the upper opening is open, and the shutter group is spaced apart from the breech element, and vice versa;

wherein, upon axial movement of the carriage assembly between the retracted configuration and the advanced configuration, the shutter group is first moved axially in translation and then is moved in roto-translation;

wherein the shutter group comprises a central body extending axially and a command pin protruding radially from said shutter body, wherein said command pin engages the assembly body so that said reciprocal interaction drives the shutter group in rotation; and wherein the breech element comprises an axially protruding portion and the carriage assembly comprises an axially hollow portion shaped for accommodating the axially protruding portion, wherein the command pin is positioned in said axially hollow portion.

11. The rifle according to claim 1, wherein the shutter group comprises a shutter head, integrally connected to the central body, which is controllable in rotation with the central body, wherein the shutter head is configured for acting with a bullet in operations of advancing the carriage assembly and in retraction operations, wherein the shutter head is configured for engaging the breech element and/or the barrel, in which the shutter head is positioned in an angular starting position corresponding to the retracted configuration of the carriage assembly and in an angular shooting position corresponding to the advanced configuration of the carriage assembly.

12. The rifle according to claim 11, wherein the shutter head is shaped and controlled in movement to execute operations of discharging a case towards one side of the rifle.

* * * * *